United States Patent [19]

MacGregor

[11] 4,247,992

[45] Feb. 3, 1981

[54] GRAIN-TOBACCO CURING BARN

[75] Inventor: James G. MacGregor, Wilmington, N.C.

[73] Assignee: Consolidated Energy Products Company, Wilmington, N.C.

[21] Appl. No.: 34,252

[22] Filed: Apr. 30, 1979

[51] Int. Cl.[3] ..... F26B 19/00

[52] U.S. Cl. ..... 34/91; 34/218; 34/233; 414/326

[58] Field of Search ..... 34/181, 203, 205, 218, 34/219, 231, 22, 233, 232, 225, 224; 198/558, 616; 414/326

[56] References Cited

U.S. PATENT DOCUMENTS

| | | | |
|---|---|---|---|
| 1,954,703 | 4/1934 | Klein | 414/326 |
| 2,641,988 | 6/1953 | Perkins | 34/233 X |
| 3,348,656 | 10/1967 | Hall et al. | 198/616 |
| 3,866,334 | 2/1975 | Huang | 34/233 X |
| 4,050,164 | 9/1977 | Campbell | 34/233 X |
| 4,114,288 | 9/1978 | Fowler | 34/218 X |

FOREIGN PATENT DOCUMENTS

| | | | |
|---|---|---|---|
| 286400 | 6/1966 | Australia | 414/326 |

*Primary Examiner*—Albert J. Makay
*Assistant Examiner*—Harold Joyce
*Attorney, Agent, or Firm*—Edward C. Threedy

[57] ABSTRACT

A convertible barn for grain or tobacco curing formed from a structural rail-like frame supporting metallic walls and roof made of corrugated sheets and the like and providing a floorless base frame arrangement that includes a longitudinally extending center beam for housing an auger element rotatable through its longitudinal length by a detachable power unit positioned externally of the barn.

The structure includes at one end a furnace room for supplying heat through its base area. The base area of the barn may be covered by a removable perforated flooring when the barn is used for curing grain and the like.

4 Claims, 7 Drawing Figures

FIG. 3.
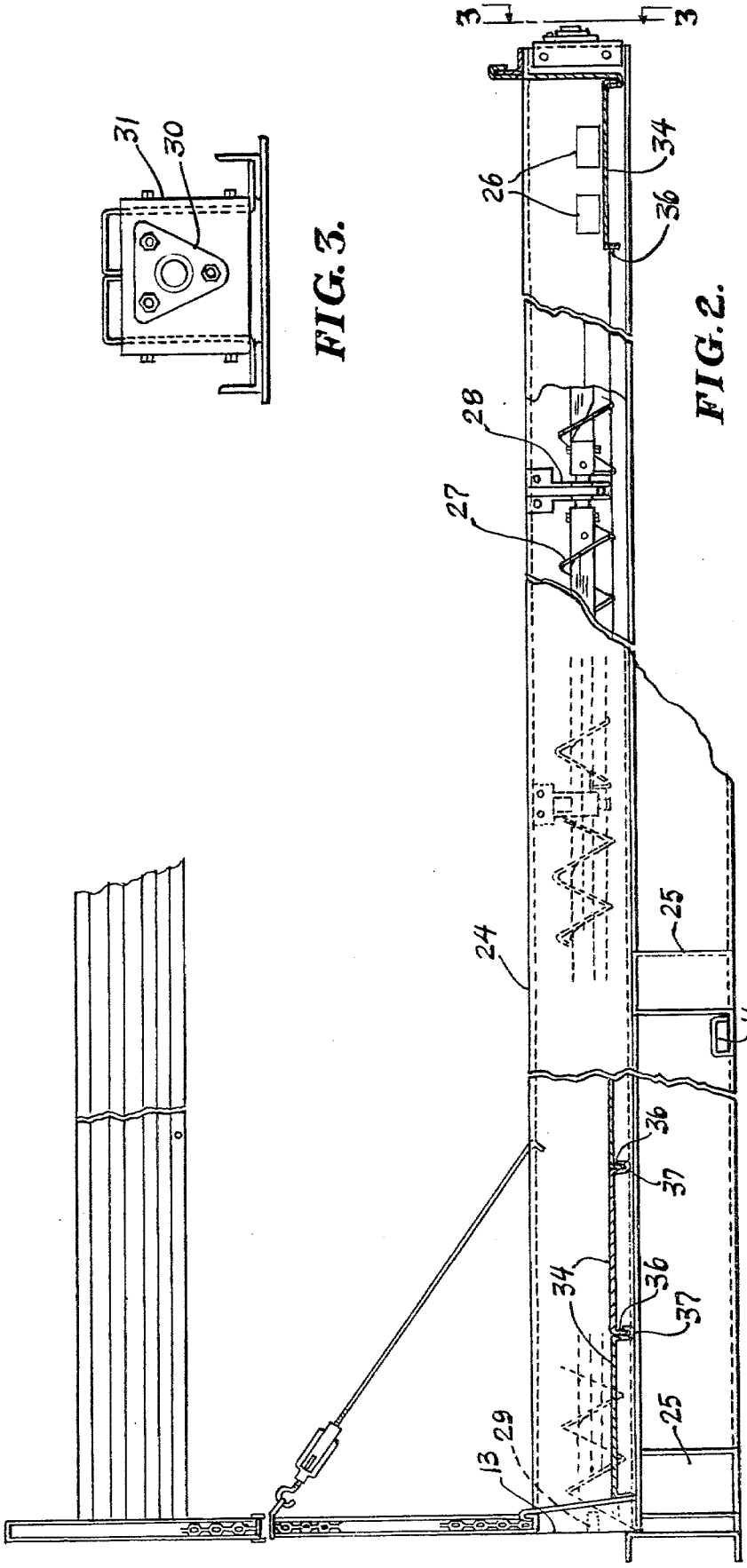
FIG. 2.
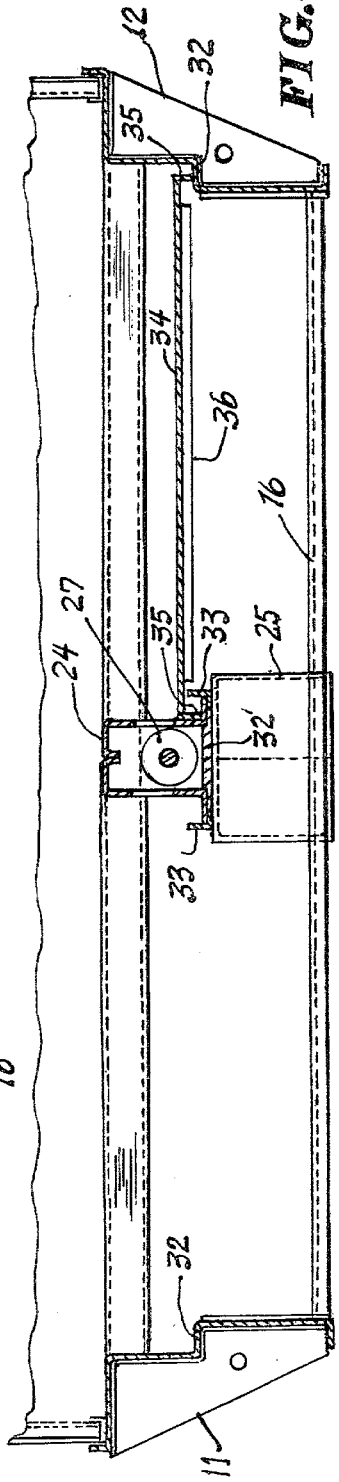
FIG. 4.

GRAIN-TOBACCO CURING BARN

SUMMARY OF THE INVENTION

It is the object of this invention to provide a barn structure which may be used for the heat curing of tobacco as well as grain drying. The grain drying operation afforded by the barn structure includes the use of an auger-type grain mover by which the dried grain can be withdrawn from the barn.

Another feature of this invention is the combination portable, detachable discharge chute and motor drive mechanism for the auger which permits the unloading of the barn through a complete external operation.

Another object of the invention is in the provision in a structure of this character of removable floor sections whereby the barn may be converted from a grain drying structure to a tobacco curing barn without structurally changing the same.

GENERAL DESCRIPTION

Figures 1, 5:
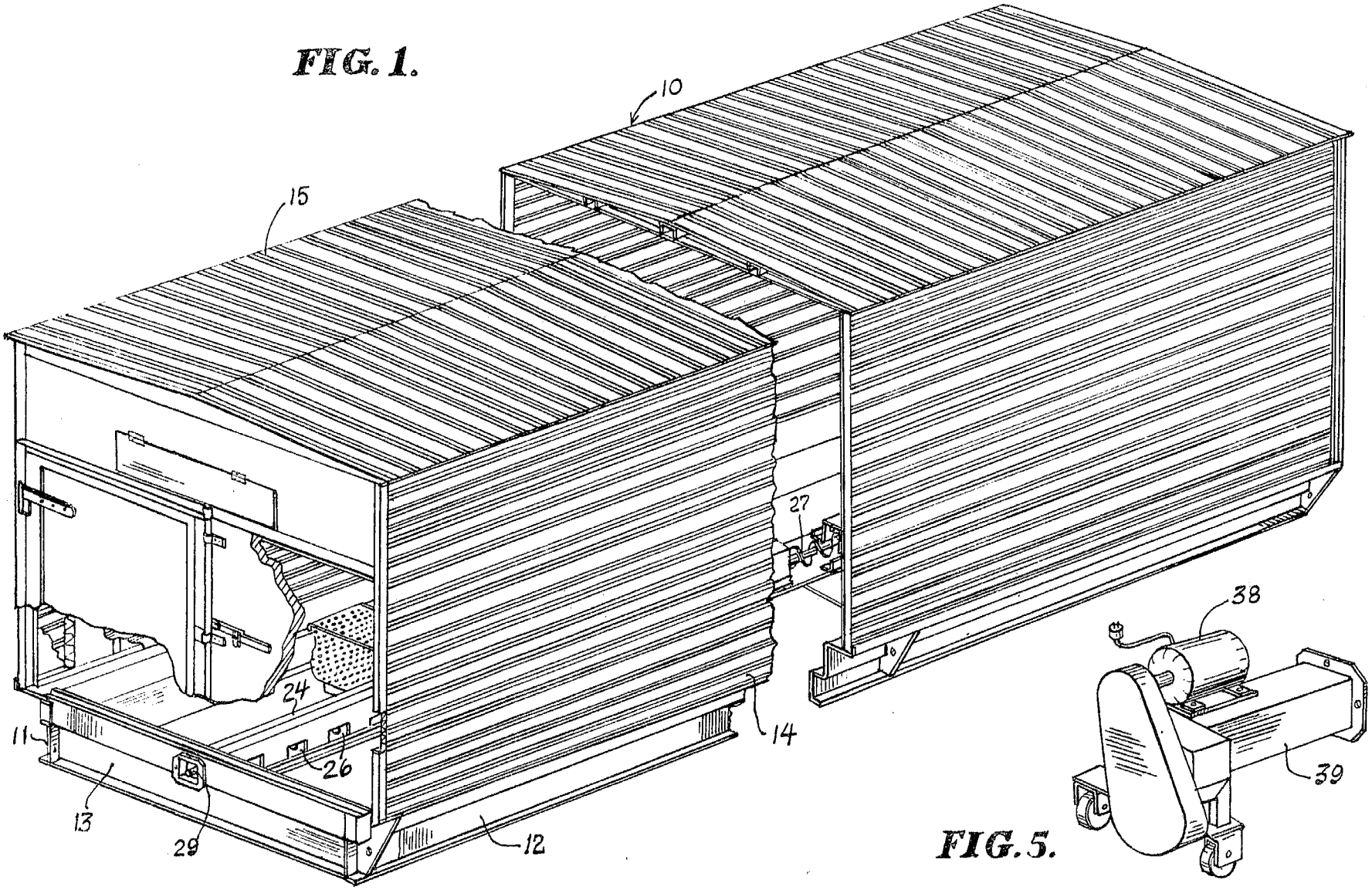

The invention will be best understood by reference to the accompanying drawings which illustrate a preferred form of construction by which the objects of the invention are achieved and in which FIG. 1 is a fragmentary perspective view of the grain-tobacco curing barn, FIG. 2 is a fragmentary detailed sectional view of the auger housing and construction as utilized in this invention.

Figure 6:
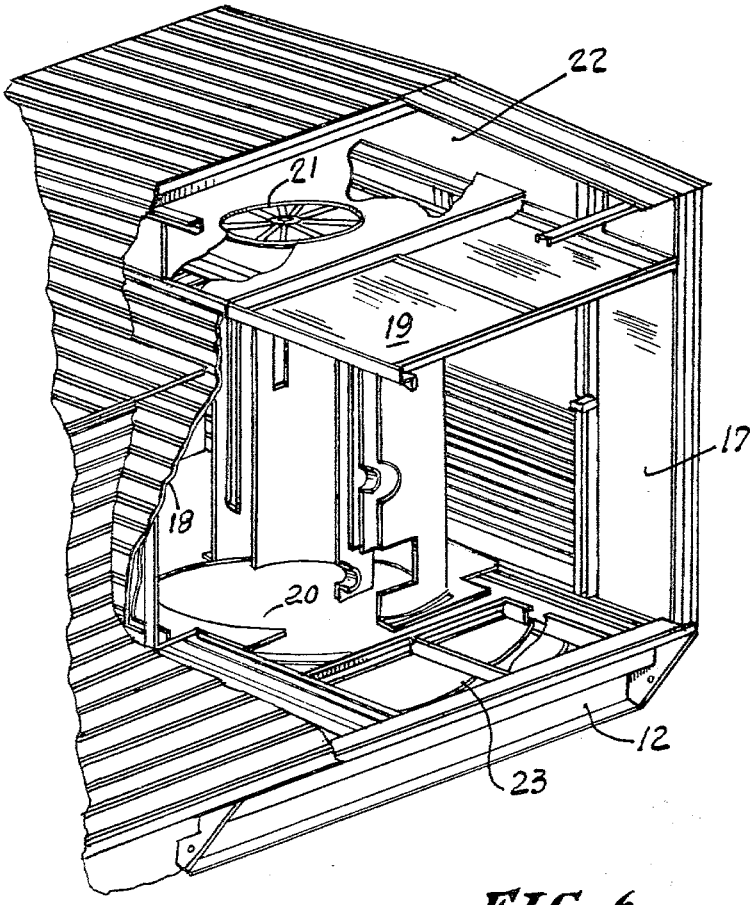
Figure 7:
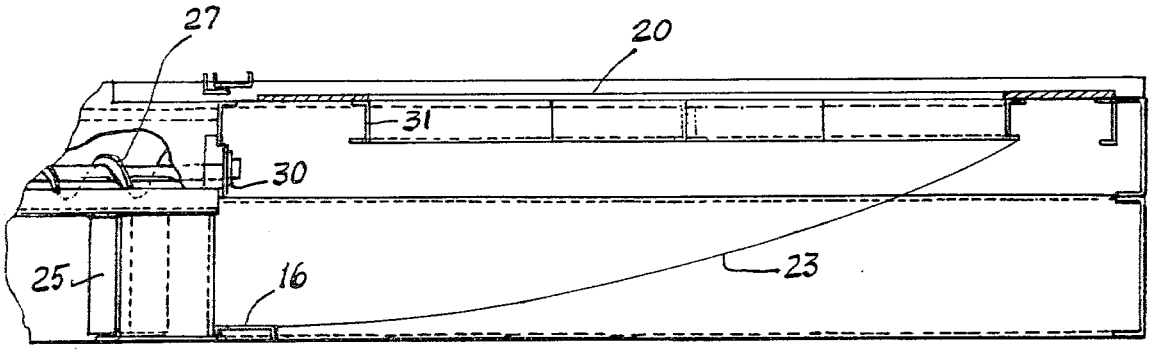

FIG. 3 is an elevational view of one end of the auger structure taken on line 3—3 of FIG. 2, FIG. 4 is fragmentary detailed sectional view showing the base frame arrangement for the barn, FIG. 5 is a perspective view of the detachable portable discharge chute and power source for the auger, FIG. 6 is a fragmentary detailed view of the furnace room arrangement, and FIG. 7 is a fragmentary detailed view of the air flow control for the barn structure.

As shown in FIG. 1, the grain-tobacco curing barn 10 is constructed from a pair of parallelly-disposed base rails 11 and 12 which are connected together at their opposite ends by thresholds 13.

The rails 11 and 12 support corrugated walls 14, which in turn support a corrugated roof 15.

Throughout the base area of the barn and extending between and connected to the rails 11 and 12 are a plurality of brace members 16 (see FIGS. 2 and 4).

At the so-called rear end of the barn 10 there is a furnace room 17. The furnace room 17 is partitioned from the rest of the barn by an interior wall 18, a ceiling 19, and an open floor 20. There is not illustrated any of the structure which makes up the furnace per se, as the same may be of any construction known in the art. The ceiling 19 is equipped with an intake fan 21, which has access to the atmosphere through an open transom 22. Beneath the furnace room 17 there is a curved heat deflector 23, which has open communication with the base area of the barn 10 beyond the partition wall 18.

Referring more specifically to FIGS. 2 and 4, there is shown a hollow rectangular beam 24 supported by a series of support columns 25. Throughout the side walls of the hollow beam 24 there are a series of openings 26 positioned in horizontal alignment so as to provide access to the interior of the beam 24. Within the hollow beam 24 is an elongated rotatable auger 27. This auger is supported throughout its longitudinal length by a series of hanger bar assemblies 28. As shown in FIG. 1, there is exposed through the threshold 13 an opening surrounding the exposed shaft end 29 of the auger 27, the purpose of which will be hereinafter more fully explained. The inner end of the auger 27 is rotatably journalled in a bearing 30 carried by a mounting assembly 31 adjacent to the open floor 20 of the furnace room 17.

Referring to FIGS. 1 and 4, the rails 11 and 12 are illustrated as being formed so as to provide a horizontally extending longitudinally disposed shoulder 32, which lies in a plane slightly higher than the base of the hollow rectangular beam 24. The bottom wall 32 of the beam 24 provides laterally extending flanges which terminate into raised track elements 33.

A series of floor plates 34 are provided and so arranged as to have opposite ends positioned upon the shoulder 32 and the track element 33, as is seen in FIGS. 1 and 4. The floor plates 34 provide at opposite ends with depending support flanges 35, and have their opposite side edges providing depending flanges 36, with one of the edge flanges 36 being reversely bent so as to provide a socket 37. As shown in FIG. 2, the floor plates 34 are so arranged that alternate side edge flanges 36 of one plate 34 will set in the socket 37 of the juxtapositioned socket 37.

When the barn is to be used as a grain drying or curing establishment the floor plates are installed and the grain is introduced into the structure. The perforations on the floor plates are of a limited size as well as in a proportionate amount in relation to the total floor area of the plate so that the loose grain will be readily supported thereon without falling through. When the grain is dried, a portable motor unit 38, which includes a discharge chute 39, is connected to the exposed shaft end 29 and operated to rotate the auger 27, which will conveniently discharge the stored dried or cured grain from the barn structure.

When the barn is used as a tobacco curing barn the floor plates 34 are removed, and the shoulders 32 and track elements 33 are so designed as to receive the wheeled undercarriage of the cribs or tobacco containers which are used in the harvesting of grain or tobacco so the same may be readily placed within the barn structure. Heat may be supplied to the structure from the furnace room 17 as required.

From the foregoing it is apparent that the structure described provides a barn assembly which may be readily converted from grain drying to tobacco curing without affecting the structure itself. When used as a grain drying barn the permanent auger discharge assembly may be readily activated by a portable power unit, which may be readily utilized to operate a series of independent barn structures, thereby reducing the initial cost for such equipment. The barn structure provides a furnace room by which heated air is directed through the floor base area of the barn to assist in either the grain drying or tobacco curing operation. The base members of the barn structure are designed so as to receive readily removable floor plates or the wheeled undercarriage of tobacco harvesting cribs or containers.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. A convertible grain drying and tobacco curing barn structure including:

(a) a frame having longitudinally extended base rails defining an open base area, (b) said rails supporting side and end walls and a roof carried by said walls, (c) a grain moving means extending along a center line between said base rails through said open base area, (d) a housing for said grain-moving means including a hollow center beam having a flat top wall and vertical side walls extending paralled to and between said base rails and having one end opening exteriorally of the end walls of the structure, (e) removeable perforated floor members supported on said side base rails and said housing, between said side base rails and said center beam and substantially below said top wall thereof, (f) means formed in said vertical side walls of said center beam above the line of junction of said floor members with said beam and through which grain freely flows from said floor members into said center beam for movement therethrough by said moving means, (g) an operating means detachably connected to said grain moving means exteriorally of the structure for operating said grain moving means so as to move grain out of said open end of said beam exteriorally of the structure, (h) an open floored furnace room at one end of the structure defined by said walls and a partition extending therebetween, and (i) a heat deflector beneath said furnace room for directing heat therefrom into said open base area of the structure and through said perforated floor members and into said center beam for moving and drying grain therein.

2. A convertible grain-drying and tobacco-curing barn structure as defined by claim 1 wherein said grain-moving means comprises an elongated rotatable auger which, when rotated by said operating means, will move the grain through said hollow center beam and out of the barn structure through said end opening.

3. A convertible grain-drying and tobacco-curing barn structure as defined by claim 1 wherein said means formed in said center beam through which grain freely flows from said floor members comprises a series of elongated openings positioned normal to said floor members and through which grain freely flows into said center beam, so as to be moved therethrough by said grain-moving means.

4. A convertible grain-drying and tobacco-curing barn structure as defined by claim 3 wherein said grain-moving means comprises an elongated rotatable auger which, when rotated by said operating means, will move the grain through said hollow center beam and out of the barn structure through said end opening.

* * * * *